US006783404B1

(12) United States Patent
Shammout

(10) Patent No.: US 6,783,404 B1
(45) Date of Patent: Aug. 31, 2004

(54) APPARATUS FOR COUPLING A JUMPER CABLE TO A BATTERY TERMINAL

(76) Inventor: Mohammed Ahmad Shammout, P.O. Box 178810, San Diego, CA (US) 92177

( * ) Notice: Subject to any disclaimer, the term of this patent is extended or adjusted under 35 U.S.C. 154(b) by 0 days.

(21) Appl. No.: 10/369,288

(22) Filed: Feb. 18, 2003

(51) Int. Cl.[7] ..... H01R 4/48
(52) U.S. Cl. ..... 439/759
(58) Field of Search ..... 439/759, 757, 439/755, 754, 819, 835

(56) References Cited

U.S. PATENT DOCUMENTS 2,470,104 A * 5/1949 Martin ..... 439/757
4,470,654 A * 9/1984 Friedman ..... 439/435
4,948,383 A * 8/1990 Tompkins ..... 439/759
5,720,633 A * 2/1998 Krivec ..... 439/759
6,254,438 B1 * 7/2001 Gaunt ..... 439/755
6,364,719 B1 * 4/2002 Chopra ..... 439/759

* cited by examiner

*Primary Examiner*—Gary Paumen
(74) *Attorney, Agent, or Firm*—Edward W. Callan

(57) ABSTRACT

A jumper-cable-coupling apparatus includes an elongated hollow tubular metal casing, an elongated metal carrier member telescopically disposed within the casing, a first connector component extending from the casing at an angle to the longitudinal axis of the casing, a second connector component extending from the carrier member in opposition to the first connector component, a spring disposed within the casing for forcing the first connector component into contact with the second connector component, and thumb and finger grips respectively disposed on the casing and the carrier member for enabling the carrier member to be moved relative to the casing to counteract the force of the spring and thereby separate the second connector component from the first connector component in order to enable the first and second connector components to be respectively disposed on opposite sides of a battery terminal and to be attached to the battery terminal.

17 Claims, 1 Drawing Sheet

APPARATUS FOR COUPLING A JUMPER CABLE TO A BATTERY TERMINAL

BACKGROUND OF THE INVENTION

The present invention generally pertains to apparatus for coupling a jumper cable to a battery terminal. Such an apparatus typically includes a first connector component; a second connector component; an electrical terminal for enabling the first and/or second connector component to be connected to a jumper cable; and a spring disposed in relation to the first and second connector components for forcing the first connector component toward contact with the second connector component; wherein the first and second connector components are adapted with insulated handles so that they can be gripped in such a manner as to counteract the spring force and thereby separate the second connector component from the first connector component in order to enable the first and second connector components to be respectively disposed on opposite sides of a battery terminal and to be attached to said battery terminal.

Due to the relatively inaccessible placement of batteries in some makes of automobiles, such as the placement of a battery closely beneath a surface of the engine compartment that underlies a dashboard, it is extremely difficult, if not impossible, to connect the connector components of a typical jumper-cable-coupling apparatus to one or both terminals of such an inaccessibly placed battery. Such difficulty is compounded by the terminals of some batteries being recessed in relation to a top rim of the battery.

SUMMARY OF THE INVENTION

The present invention provides an apparatus for coupling a jumper cable to a battery terminal, comprising: an elongated member; a first connector component extending from the elongated member; a carrier member coupled to the elongated member and disposed for movement relative to the elongated member along or parallel to the longitudinal axis of the elongated member; a second connector component extending from the carrier member in opposition to the first connector component; terminal means for enabling the first and/or second connector component to be connected to a jumper cable; first means disposed in relation to the elongated member and the carrier member for forcing the first connector component toward contact with the second connector component; and second means for enabling the carrier member to be moved relative to the elongated member to counteract the force of the first means and thereby separate the second connector component from the first connector component in order to enable the first and second connector components to be respectively disposed on opposite sides of a battery terminal and to be attached to said battery terminal; wherein the elongated member includes a tube within which the carrier member is telescopically disposed.

In another aspect the present invention provides apparatus for coupling a jumper cable to a battery terminal, comprising: an elongated casing having a restrained end and an open end; a first connector component extending from the casing; an elongated carrier member disposed within the casing and extending from the open end of the casing, wherein the carrier member is disposed for movement relative to the casing along or parallel to the longitudinal axis of the casing; a second connector component extending from the carrier member in opposition to the first connector component; means for enabling the first and/or second connector component to be connected to a jumper cable; a spring disposed within the casing between the carrier member and the restrained end of the casing for forcing the first connector component toward contact with the second connector component; and gripping means for enabling the carrier member to be moved relative to the casing to counteract the force of the spring and thereby separate the second connector component from the first connector component in order to enable the first and second connector components to be respectively disposed on opposite sides of a battery terminal and to be attached to said battery terminal, wherein the gripping means comprise: a first grip affixed to the casing; and a second grip affixed to the movable carrier member and extending through at least one aperture in an intermediate portion of the casing.

The jumper-cable-coupling apparatus of the present invention can easily be connected to the terminals of batteries that are placed in relatively inaccessible portions of an automobile engine compartment and to battery terminals that are recessed in relation to a top rim of the battery.

Additional features of the present invention are described with reference to the detailed description of the preferred embodiments.

BRIEF DESCRIPTION OF THE DRAWING

FIG. 2 is rotated 180 degrees with respect to FIG. 1.

DETAILED DESCRIPTION

Figures 1, 2:
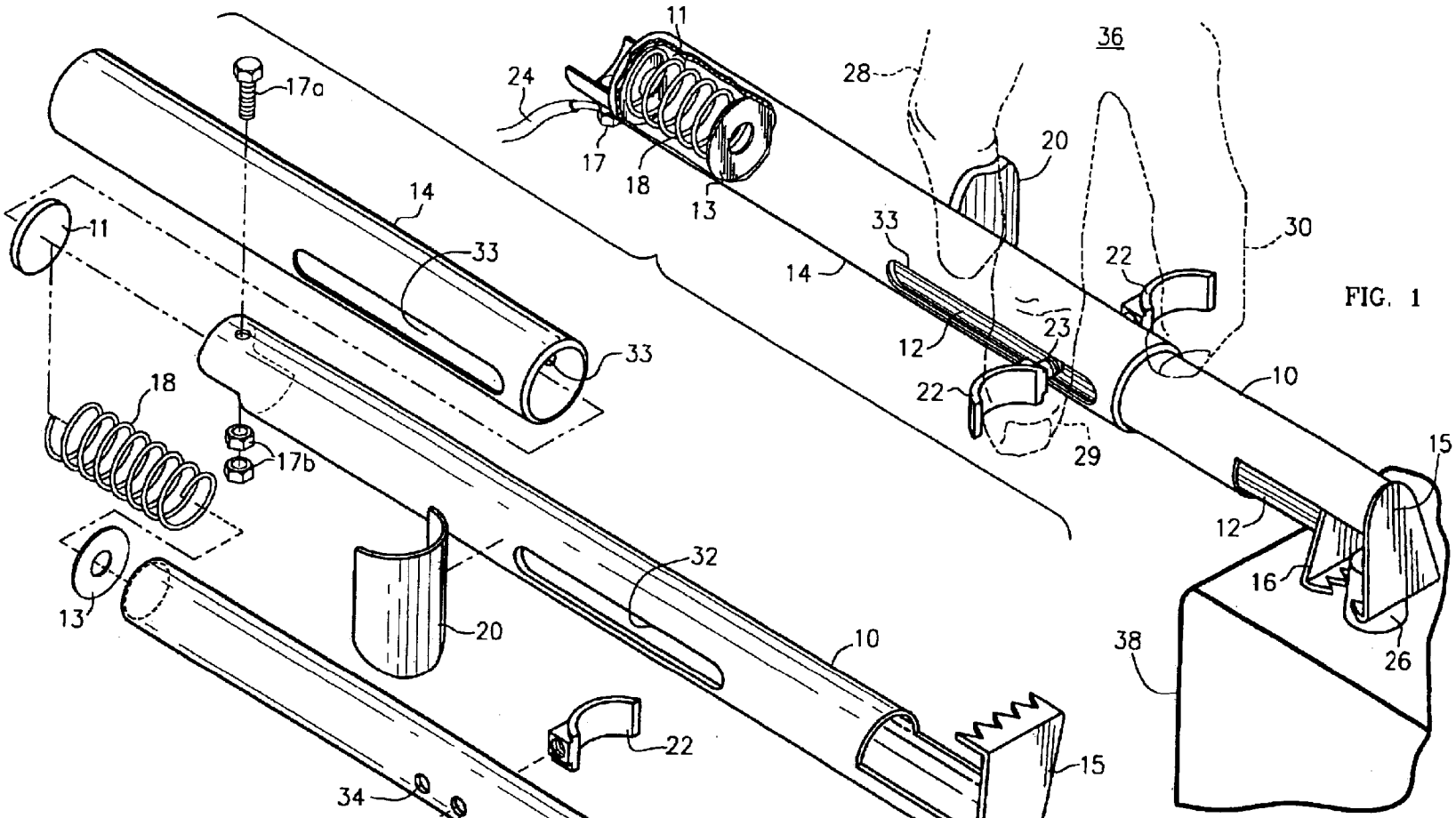
FIG. 1 is a partially broken-away isometric view of the jumper-cable-coupling apparatus of the present invention being gripped for enabling connection to a battery terminal.
FIG. 2 is an exploded isometric view of the components of the jumper-cable-coupling apparatus of FIG. 1.

Referring to the Drawing, a preferred embodiment of the jumper-cable-coupling apparatus of the present invention includes an elongated hollow tubular metal casing 10, a restraining wall 11, an elongated metal carrier member 12, a washer 13, a layer of thermal and electrical insulating material 14, a first connector component 15, a second connector component 16, connector terminal elements 17*a*, 17*b*, a spring 18, a thumb grip 20, two finger grips 22 and a rod 23.

The restraining wall 11 is at one end of the hollow elongated casing 10 and the other end of the hollow casing 10 is open. The first connector component 15 is a metal claw that extends from the metal casing 10 at an angle to the longitudinal axis of the casing 10. The layer of insulating material 14 covers the portion of the casing 10 that extends from the restrained end of the casing 11 past the two finger grips 22.

The elongated carrier member 12 is telescopically disposed within the casing 10 and extends from the open end of the casing 10. The carrier member 12 is disposed for movement relative to the casing 10 along the longitudinal axis of the casing 10. The second connector component 16 extends from the carrier member 12 in opposition to the first connector component 15.

The connector terminal elements 17*a*, 17*b* are disposed at the restrained end of the elongated metal casing 10 for enabling the first connector component 15 to be electrically connected via the metal casing 10 to a jumper cable 24.

The spring 18 is disposed within the casing 10 between the carrier member 12 and the restraining wall 11 at the restrained end of the casing 10 for forcing the first connector component 15 toward contact with the second connector component 16. Although, in the preferred embodiment, the relative dimensions of the elongated casing 10, the carrier member 12 and the spring 18 are such that the spring forces the first connector component 15 into contact with the second connector component 16, such contact is not required, provided that any separation between the first connector component 15 and the second connector component 16 when forced toward one another is less than the thickness of a battery terminal. In the preferred embodiment, the carrier member 12 is a hollow tube; and the washer 13 is disposed within the casing 10 to provide a firm barrier between the spring 18 and the carrier member 12.

The thumb grip 20 and the two finger grips 22, which are covered by thermal and electrical insulating material, are disposed for enabling the carrier member 12 to be moved relative to the casing 10 to counteract the force of the spring 18 and thereby separate the second connector component 16 from the first connector component 15 in order to enable the first and second connector components 15, 16 to be respectively disposed on opposite sides of a battery terminal 26 and to be attached to the battery terminal 26. The jumper-cable-coupling apparatus can be rotated ninety-degrees from the orientation shown in FIG. 1 for attachment of the first and second connector components 15, 16 to the battery terminal 26 from the side if there is not enough clearance space to enable attachment from above, as shown in FIG. 1.

The thumb grip 20 is shaped for gripping by a person's thumb 28 and is affixed to the casing 10. The two finger grips 22 are shaped for gripping by two of a person's fingers 29, 30, are affixed to the movable carrier member 12 by the rod 23 and respectively extend through two apertures 32 in opposite sides of an intermediate portion of the casing 10 and two respectively adjacent apertures 33 in opposite sides of the insulating layer 14 for gripping by two of a person's fingers 29, 30 placed on respectively opposite sides of the casing 10.

In the preferred embodiment, the thumb grip 20 is disposed closer than the two finger grips 22 to the restrained end 11 of the casing 10. In an alternative embodiment (not shown), the thumb grip 20 is further away than the two finger grips 22 from the restrained end 11 of the casing 10.

The carrier member 12 is adapted by a plurality of apertures 34 for enabling the finger grips 22 to be affixed at different positions parallel to the longitudinal axis of the carrier member 12 in accordance with the rod 23 being disposed through a selected one of the apertures 34.

The thumb grip 20 and the two finger grips 22 are so displaced away from the first and second connector components 15, 16 as to prevent a person's hand 36 that is gripping the thumb grip 20 and the two finger grips 22 from contacting the battery 38 while the first and second connector components 15, 16 are being attached to the battery terminal 26.

In various alternative embodiments (not shown), (a) the first connector component does not extend from the elongated casing at an angle to the longitudinal axis of the casing; (b) the second connector component does not extend from the carrier member at an angle to the longitudinal axis of the casing; (c) the movable carrier member is not disposed within the casing; (d) means other than, or in addition to, a spring are disposed in relation to the casing and the carrier member for forcing the first connector component toward contact with the second connector component; (e) means other than thumb and finger grips are disposed for enabling the carrier member to be moved relative to the casing to counteract the force that forces the second connector component toward contact with the first connector component; (f) the casing and/or the carrier member are not made of an electrically conductive material, whereby the jumper cable is connected to the first and/or second connector component; and/or (g) the restrained end of the casing includes a small opening instead of a solid restraining wall.

The present invention also provides a set of jumper cables, wherein at least one of the cables is connected to at least one jumper-cable-coupling apparatus according to the present invention.

The benefits specifically stated herein do not necessarily apply to every conceivable embodiment of the present invention. Further, such stated benefits of the present invention are only examples and should not be construed as the only benefits of the present invention. While the above description contains many specificities, these should not be construed as limitations on the scope of the present invention, but rather as examples of the preferred embodiments described herein. Other variations are possible and the scope of the present invention should be determined not by the embodiments described herein but rather by the claims and their legal equivalents.

What is claimed is:

1. Apparatus for coupling a jumper cable to a battery terminal, comprising:

an elongated member;

a first connector component extending from the elongated member;

a carrier member coupled to the elongated member and disposed for movement relative to the elongated member along or parallel to the longitudinal axis of the elongated member;

a second connector component extending from the carrier member in opposition to the first connector component;

terminal means for enabling the first and/or second connector component to be connected to a jumper cable;

first means disposed in relation to the elongated member and the carrier member for forcing the first connector component toward contact with the second connector component; and second means for enabling the carrier member to be moved relative to the elongated member to counteract the force of the first means and thereby separate the second connector component from the first connector component in order to enable the first and second connector components to be respectively disposed on opposite sides of a battery terminal and to be attached to said battery terminal;

wherein the elongated member includes a tube within which the carrier member is telescopically disposed.

2. Apparatus according to claim 1, wherein the first connector component extends from the elongated member at a given angle to the longitudinal axis of the elongated member.

3. Apparatus according to claim 1, wherein the second means are so displaced away from the first and second connector components as to prevent a person's hand that is gripping the second means from contacting the battery.

4. A set of jumper cables, wherein at least one of the cables is connected to at least one apparatus according to claim 1.

5. Apparatus for coupling a jumper cable to a battery terminal, comprising:

an elongated casing having a restrained end and an open end;

a first connector component extending from the casing;

an elongated carrier member disposed within the casing and extending from the open end of the casing, wherein the carrier member is disposed for movement relative to the casing along or parallel to the longitudinal axis of the casing;

a second connector component extending from the carrier member in opposition to the first connector component;

means for enabling the first and/or second connector component to be connected to a jumper cable;

a spring disposed within the casing between the carrier member and the restrained end of the casing for forcing the first connector component toward contact with the second connector component; and gripping means for enabling the carrier member to be moved relative to the casing to counteract the force of the spring and thereby separate the second connector component from the first connector component in order to enable the first and second connector components to be respectively disposed on opposite sides of a battery terminal and to be attached to said battery terminal;

wherein the gripping means comprise;

a first grip affixed to the casing; and a second grip affixed to the movable carrier member and extending through at least one aperture in an intermediate portion of the casing.

6. Apparatus according to claim 5, wherein the first grip is shaped for gripping by a person's thumb and the second grip is shaped for gripping by at least one of a person's fingers.

7. Apparatus according to claim 6, wherein the second grip includes two components respectively extending through two said apertures in opposite sides of the casing for gripping by two of a person's fingers on respectively opposite sides of the casing.

8. Apparatus according to claim 5, wherein the first grip is disposed closer than the second grip to the restrained end of the casing.

9. Apparatus according to claim 5, wherein, wherein the carrier member is adapted for enabling the second grip to be affixed at different positions along or parallel to the longitudinal axis of the carrier member.

10. Apparatus according to claim 5, wherein the first connector component extends from the casing at a given angle to the longitudinal axis of the casing.

11. Apparatus according to claim 5, wherein the casing includes a tube within which the carrier member is telescopically disposed.

12. Apparatus according to claim 5, wherein the gripping means are so displaced away from the first and second connector components as to prevent a person's hand that is gripping the gripping means from contacting the battery.

13. A set of jumper cables, wherein at least one of the cables is connected to at least one apparatus according to claim 5.

14. Apparatus for coupling a jumper cable to a battery terminal, comprising:

an elongated casing having a restrained end and an open end;

a first connector component extending from the casing;

an elongated carrier member disposed within the casing and extending from the open end of the casing, wherein the carrier member is disposed for movement relative to the casing along or parallel to the longitudinal axis of the casing;

a second connector component extending from the carrier member in opposition to the first connector component;

means for enabling the first and/or second connector component to be connected to a jumper cable;

a spring disposed within the casing between the carrier member and the restrained end of the casing for forcing the first connector component toward contact with the second connector component; and gripping means for enabling the carrier member to be moved relative to the casing to counteract the force of the spring and thereby separate the second connector component from the first connector component in order to enable the first and second connector components to be respectively disposed on opposite sides of a battery terminal and to be attached to said battery terminal;

wherein the casing includes a tube within which the carrier member is telescopically disposed.

15. Apparatus according to claim 14, wherein the first connector component extends from the casing at a given angle to the longitudinal axis of the casing.

16. Apparatus according to claim 14, wherein the gripping means are so displaced away from the first and second connector components as to prevent a person's hand that is gripping the gripping means from contacting the battery.

17. A set of jumper cables, wherein at least one of the cables is connected to at least one apparatus according to claim 14.

* * * * *